US005411278A

United States Patent [19]

Wittmann

[11] Patent Number: 5,411,278

[45] Date of Patent: May 2, 1995

[54] SKATING SHOE

[75] Inventor: Walter Wittmann, Köflach, Austria

[73] Assignee: Koflach Sport Gesellschaft m.b.H. & Co. KG., Wagrain, Austria

[21] Appl. No.: 238,575

[22] Filed: May 5, 1994

Related U.S. Application Data

[63] Continuation of Ser. No. 920,895, Jul. 28, 1992, abandoned.

[30] Foreign Application Priority Data

Jul. 31, 1991 [AT] Austria ..... 91/1530

[51] Int. Cl.[6] ..... A63C 17/06; A63C 17/18

[52] U.S. Cl. ..... 280/11.22; 280/7.13; 280/11.27; 36/115

[58] Field of Search ..... 280/11.22, 11.23, 11.25, 280/11.27, 11.28, 7.13, 7.14; 36/3 A, 87, 115; 301/5.3

[56] References Cited

U.S. PATENT DOCUMENTS

| | | | |
|---|---|---|---|
| 2,307,874 | 1/1943 | Bilde | 301/5.3 |
| 2,868,553 | 1/1959 | Rieckman | 280/11.27 X |
| 2,944,827 | 7/1960 | Makara | 280/11.28 |
| 3,043,600 | 7/1962 | Voakes . | |
| 3,351,353 | 11/1967 | Weitzner . | |
| 4,008,901 | 2/1977 | Conn | 280/7.13 |
| 4,107,856 | 8/1978 | Bourque | 36/115 |
| 4,126,323 | 11/1978 | Scherz | 36/115 X |
| 4,657,265 | 4/1987 | Ruth | 280/7.13 |
| 4,666,169 | 5/1987 | Hamill et al. | 280/11.23 |
| 4,693,021 | 9/1987 | Mazzarolo | 36/3 A X |
| 4,932,675 | 6/1990 | Olson et al. | 280/11.22 X |
| 4,979,317 | 12/1990 | Fukuoka | 36/3 A |

FOREIGN PATENT DOCUMENTS

| | | | |
|---|---|---|---|
| 0117372 | 9/1984 | European Pat. Off. | 36/115 |
| 0295081 | 12/1988 | European Pat. Off. . | |
| 2291715 | 6/1976 | France . | |
| 2322718 | 11/1974 | Germany . | |
| 2447330 | 4/1976 | Germany . | |
| 3513022 | 10/1985 | Germany . | |
| 3911899 | 10/1990 | Germany . | |
| 95257 | 7/1960 | Netherlands | 280/11.22 |

*Primary Examiner*—Brian L. Johnson
*Attorney, Agent, or Firm*—Collard & Roe

[57] ABSTRACT

A skating shoe comprises a shell defining an interior space for receiving a foot and including a sole, a shaft connected to the shell and projecting therefrom for receiving a portion of a leg extending from the foot, a heat-insulating layer extending along the sole and facing the interior space, and tensioning elements affixed to the shell and the shaft for tightening the shell and the shaft about a foot and leg portion received in the interior space and the shell. A bearing device for skating rollers or an ice skating blade supports the skating shoe on a support surface and extends in a longitudinal direction along an underside of the sole and being affixed thereto, and a bearing housing for the skating rollers or ice skating blade extends towards the support surface and is form-fittingly connected to the bearing device.

4 Claims, 7 Drawing Sheets

SKATING SHOE

CROSS-REFERENCE TO RELATED APPLICATION

This is a continuation of my application Ser. No. 07/920,895, filed Jul. 28, 1992, and now abandoned.

BACKGROUND OF THE INVENTION

1. Field of the Invention

The present invention relates to a skating shoe, particularly a roller or ice skating shoe, comprising a shell defining an interior space for receiving a foot and including a sole, a shaft connected to the shell and projecting therefrom for receiving a portion of a leg extending from the foot, a heat-insulating layer, such as an inner sole, extending along the sole and facing the interior space, and tensioning elements affixed to the shell and the shaft for tightening the shell and the shaft about a foot and leg portion received in the interior space and the shell.

2. Description of the Prior Art

Published German patent application No. 3,911,899 discloses a skating shoe with skating rollers and/or ice skating blades arranged sequentially in the longitudinal direction and a carrier frame for the rollers, which is affixed to the sole. If the shoe is to be used for ice skating, the fastening elements for the carrier frame must be loosened and a carrier frame with an ice skating blade must be attached to the shoe sole, making the retrofitting for the selected use of the shoe time-consuming and inconvenient. In addition, the stability is reduced after a few such mountings and dismountings, which may make the shoe unfit for wear.

Published European patent application No. 295,081 discloses a shoe equipped with a carrier housing for rollers on the underside of the sole. The carrier housing is a shaped element which may be of injection molded synthetic resin or cast metal and has means for receiving bearings for the rollers and mounting plates for attachment to the sole. Its stability is enhanced by arranging ribs extending transversely to the shoe between the rollers. This skating shoe, too, requires anchoring means in the shoe sole for the fastening elements of the carrier housing, and the sole has to be reinforced to absorb the lateral forces exerted on the sole through the anchoring means. Therefore, these shoes are quite heavy, which makes their wear for any length of time uncomfortable.

Published German patent application No. 3,513,022 also discloses a skating shoe equipped with sequentially arranged rollers exchangeable for ice skating blades. The sole has projecting anchoring elements received in correspondingly shaped housing elements for rollers or skating blades. Manufacturing tolerances cause unequal wear and corresponding misfits in the anchoring elements and the correspondingly shaped housing elements after long-time use, which causes deviations in the roller position and correspondingly unsafe operating conditions.

SUMMARY OF THE INVENTION

It is the primary object of this invention to provide a skating shoe for roller and/or ice skating with a shell, preferably of synthetic resin, which exhibits a high stability for the roller and/or ice skating blade bearing while being light and using a minimum of parts.

The above and other objects are accomplished according to the invention in a skating shoe of the first-indicated structure with a bearing device for skating means supporting the skating shoe on a support surface and extending in a longitudinal direction along an underside of the sole and being affixed thereto, and a bearing housing for the skating means extends towards the support surface and is form-fittingly connected to the bearing device. The shell and shaft are preferably comprised of a synthetic resin, and the skating means comprises rollers and/or an ice skating blade.

The advantage of this structure resides in the simplified manufacture compared with that of separate bearing arrangements for the rollers and the ice skating blades. In addition, the shoes may be readily and exchangeably fitted either with bearing devices for rollers or blades.

According to a preferred embodiment, the bearing device forms the bearing housing and the shoe further comprises a support housing part and coupling means affixing the support housing part. This has the advantage that the bearing device has a small cross section in the area of the bearing, which provides sufficient space for an oblique positioning particularly important when the shoe is used in sport competition. The coupling means is preferably comprised of cooperating and complementary guide arrangements in the bearing housing and the support housing part. This assures a correct positioning of the support housing part relative to the bearing housing. In this way, the shoe may be rapidly retrofitted for roller or ice skating.

According to another preferred embodiment, the bearing housing is comprised of two parts arranged at respective sides of a plane of symmetry extending vertically through the shoe in the longitudinal direction, and at least one of the bearing housing parts is integral with the sole. This provides flexural stiffness resisting strong forces, particularly lateral impacts. In addition, it saves an extra manufacturing step as well as a separate mounting step and additional fastening elements, thus providing considerable cost savings. The bearing housing parts preferably define cooperating and complementary recesses arranged symmetrically with respect to the plane of symmetry, the skating means being held in the recesses. This enables the rollers to be integrated in these housing parts and to protect the bearings for the rollers from being penetrated by foreign bodies, such as dirt.

The skating shoe may further comprise connecting means arranged between the bearing housing and the shell, such as threaded bolts frictionally fitted in the bearing housing or the shell. This enables the parts to be exchanged if they are damaged, for example, and if the connecting means are threaded bolts, they can be used at the same time for properly positioning the part.

According to a preferred feature, the bearing housing has opposite side faces defining recesses constituting zones of elasticity and weakness in the bearing housing. This provides an elastic deformability enabling the bearing housing to absorb shocks, which enhances the operation of the shoe. A material may be lodged in the recesses, the material differing from that of the shell and having vibration damping properties. In this way, the elasticity may be individually adjusted to the operating conditions, such as the nature of the skating surface or the weight of the user.

The skating shoe may comprise elastic support bushings for the skating means having a radial elasticity.

This provides vibration damping means and makes it possible, for example, to use a wear-resistant material for the rollers. Preferably, a vertical adjustment device is provided for the support bushings. In this way, the roller positions may be adjusted to obtain a uniform support even when they have been worn down to different diameters, which provides for a comfortable use over a long period of time. The vertical adjustment device may be comprised of a rotary axle extending through a bore in the support bushings eccentrically relative to a circumference of the bushings. This makes an effective and stepless vertical adjustment of the rollers possible.

If the skating means comprises rollers having a center axis, the shoe may further comprise support elements extending concentrically about the center axis and holding the rollers in the bearing housing part. This enables the rollers do be readjusted into various positions.

If the skating means comprises an ice skating blade, the shoe may further comprise elastic clamping elements received in recesses in the bearing housing part, the ice skating blade having an extension projecting into the clamping elements and held thereby. In this way, the ice skating blades may be properly positioned in the longitudinal direction. The elastic clamping elements are preferably substantially cylindrical and have an axis substantially coincident with a center axis of the bearing housing part. Such elements may be very economically manufactured without requiring special shaping. These elements may be integral with an extension of the ice skating blades so that no special element is required for the fastening of the blades.

Finally, the shell may define breathing openings. This will prevent overheating of the interior shell space and corresponding formation of sweat, particularly during the use of the shoe in the summertime.

BRIEF DESCRIPTION OF THE DRAWING

The above and other objects, advantages and features of the invention will become more apparent from the following detailed description of certain now preferred embodiments, taken in conjunction with the accompanying drawing wherein.

DETAILED DESCRIPTION OF PREFERRED EMBODIMENTS

Figure 1:
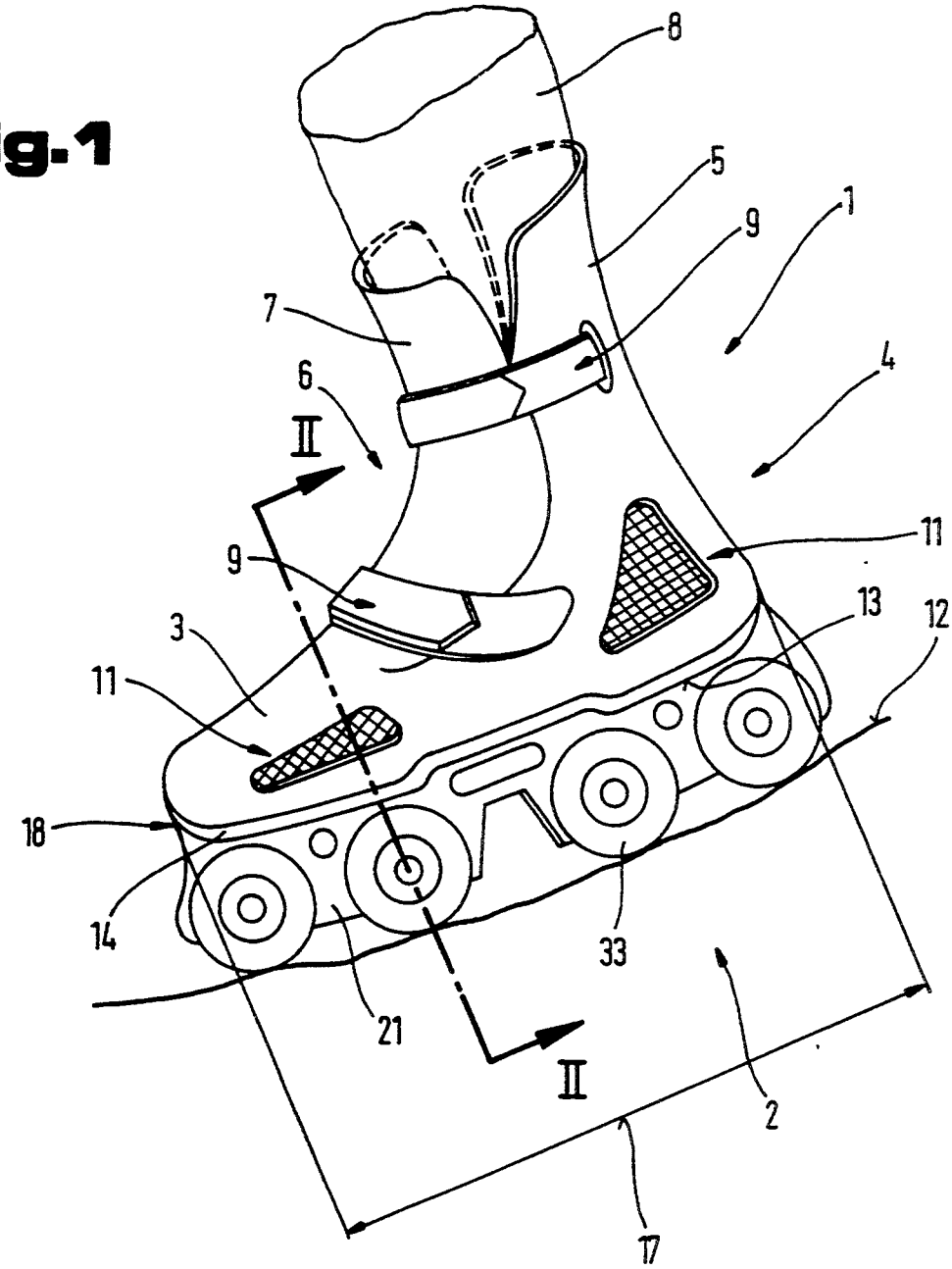
FIG. 1 is a schematic perspective view of a roller skating shoe according to the present invention.
Figure 3:
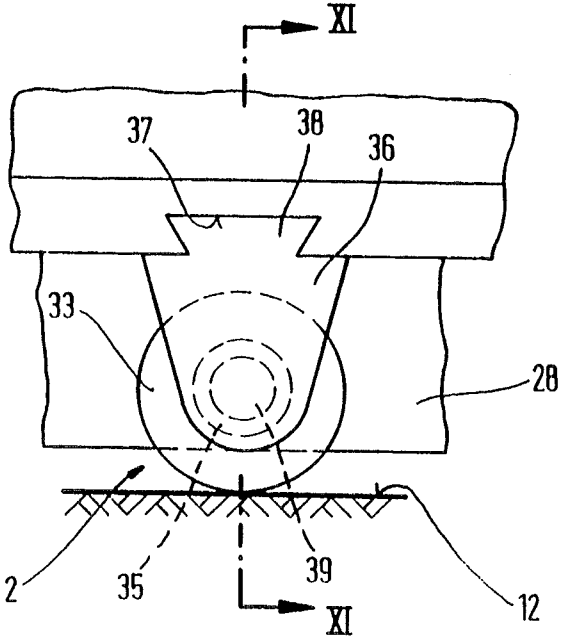
FIG. 3 is a fragmentary side elevation showing the roller bearing in a housing support element.
Figure 2:
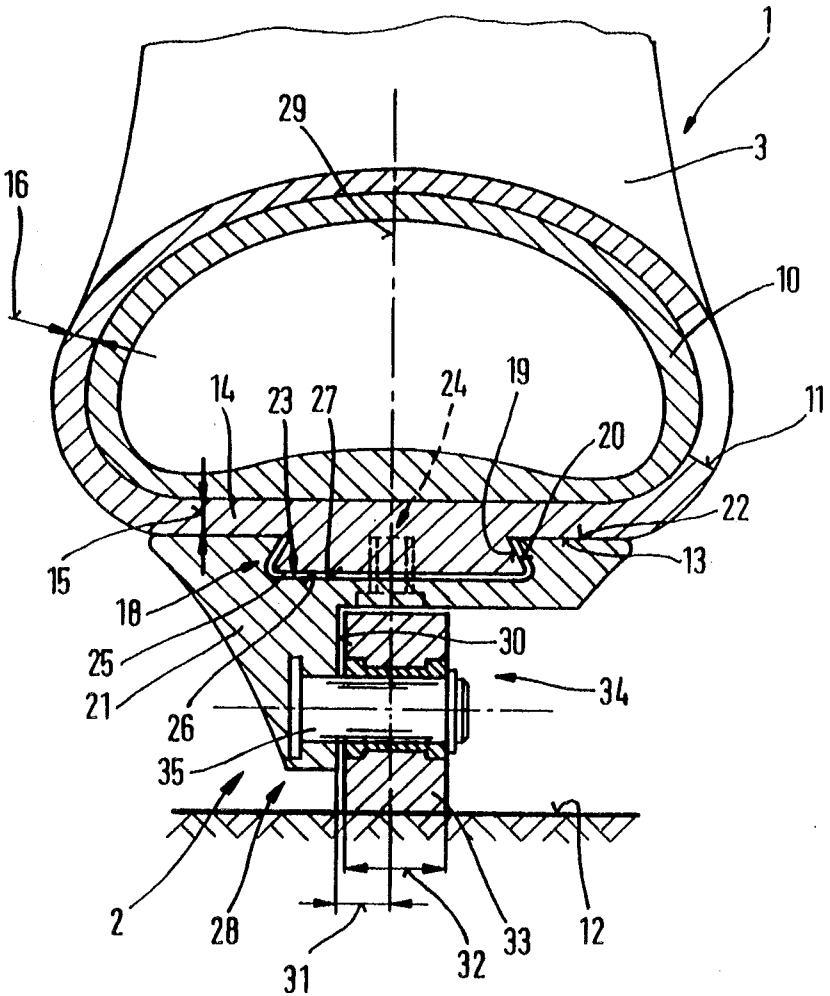
FIG. 2 is a section along line II—II of FIG. 1.

Referring now to the drawing and first to FIGS. 1 to 3, there is shown skating shoe 1 which, in the illustrated embodiment, is an integral injection molded synthetic resin part comprising shell 3 defining an interior space for receiving a foot and including sole 14, and a shaft connected to the shell and projecting therefrom for receiving a portion of leg 8 extending from the foot. The shaft is comprised of semi-cylindrical shaft part 5 projecting upwardly from heel 4 and another semi-cylindrical shaft part 7 projecting upwardly from joint 6. A heat-insulating layer, for example elastic inner sole 10, extends along the sole and faces the interior space. Such layers or inner shoes are well known in mountain climbing and ski boots and preferably are made of an air-permeable material, such as a synthetic resin foam, to avoid or reduce formation of sweat. This effect may be enhanced by providing breathing openings 11 in shell 3 and/or in the shaft. A backing is provided for openings 11 to cover the interior space of the shell and prevent penetration of foreign bodies into the interior of the shoe. The material of this backing has such properties that atmospheric heat is prevented from reaching the foot and leg if the shoe is used under high temperature conditions and that heat from the foot and leg is reflected thereby when the shoe is used in cold weather. Tensioning elements 9 are affixed to shell 3 and shaft 5, 7 for tightening the shell and the shaft about a foot and leg portion received in the interior space and the shell.

As shown in FIG. 2, the stability of shoe 1 is enhanced by giving sole 14 of shell 3 a thickness 15 which is greater than thickness 16 of the shell.

Bearing device 18 for skating rollers 33 supporting skating shoe 1 on support surface 12 extends in a longitudinal direction along length 17 of sole 14, the bearing device extending along underside 13 of the sole and being affixed thereto. In the illustrated embodiment, the bearing device is formed integrally with the sole and is a dove-tailed element having side faces 20 tapering conically outwardly towards support surface 12 and relative to vertical plane of symmetry 29 extending through the shoe. Bearing housing 21 for rollers 33 extends towards the support surface and is form-fittingly connected to bearing device 18, upper side 22 of bearing housing 21 defining recess 23 corresponding in cross section to dove-tailed bearing device 18 which has guide faces 19 constituted by side faces 19.

As shown in FIG. 2, bearing housing 21 may be permanently or detachably connected to bearing device 18. For a permanent connection, adhesive layer 25 is arranged between contact faces 26, 27 of the bearing housing and the bearing device integral with shell 3. Detachable connecting means 24 comprised of threaded bolts frictionally fitted in the bearing housing or the shell is shown in broken lines.

Bearing housing 21 has a ledge-shaped extension 28 extending in the direction of length 17 of the sole and projecting towards support surface 12. Side face 30 of ledge-shaped extension 28 facing plane of symmetry 29 extends parallel to the plane of symmetry at a distance 31 therefrom, which distance slightly exceeds half the width 32 of rollers 33 of roller arrangement 2. The rollers are rotatably journaled on bearing arrangement 34 about horizontal rotary axle 35 which is anchored in ledge-shaped extension 28. This provides a free bearing for the rollers and enables them to be rapidly replaced when they are worn or otherwise damaged.

Figure 11:
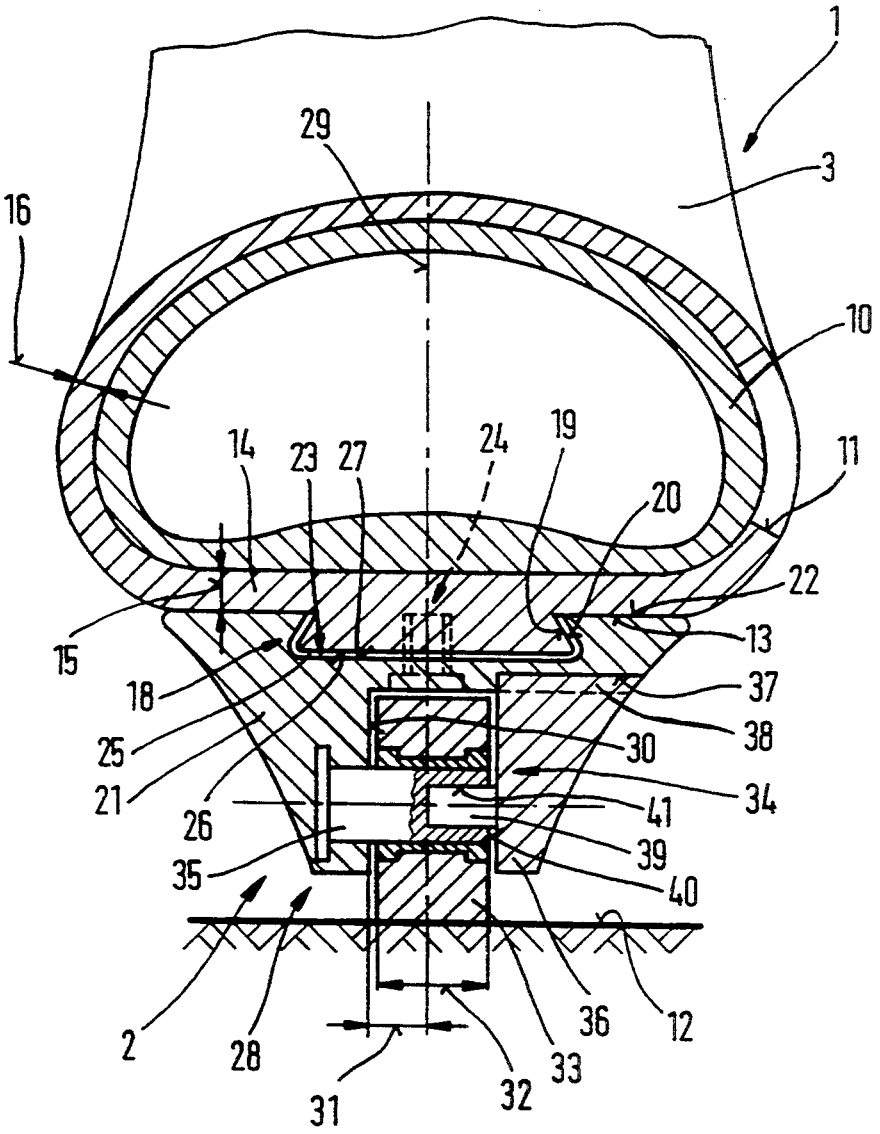
FIG. 11 is a section along line II—II of FIG. 1, showing a modification of the embodiment of FIG. 2.

The stability of roller arrangement 2 is enhanced and its weight support capacity is increased by a modification illustrated in FIG. 11 wherein like reference numerals designate like parts. In this embodiment, a support housing part 36 is provided to change the free bearing of rotary axle 35 for rollers 33 selectively into bearing 34 in which the roller is supported at both sides. In this case, as illustrated in FIG. 3, bearing housing 21 defines transversely extending grooves 37, which are illustrated as dove-tailed grooves, and these grooves receive correspondingly shaped guide rib 38 of support housing part 36. This housing part has a support bolt 39 coaxial with rotary axle 35 and engaging recess 41 in end face 40 of the rotary axle. If desired, each roller may have such a support bearing arrangement 34. However, it is also possible to provide a ledge-shaped support housing part 36 extending in the longitudinal direction and carrying a succession of support bolts cooperating with the rotary axles of the rollers whereby a common support bearing is provided for all the rollers of roller arrangement 2.

Figure 4:
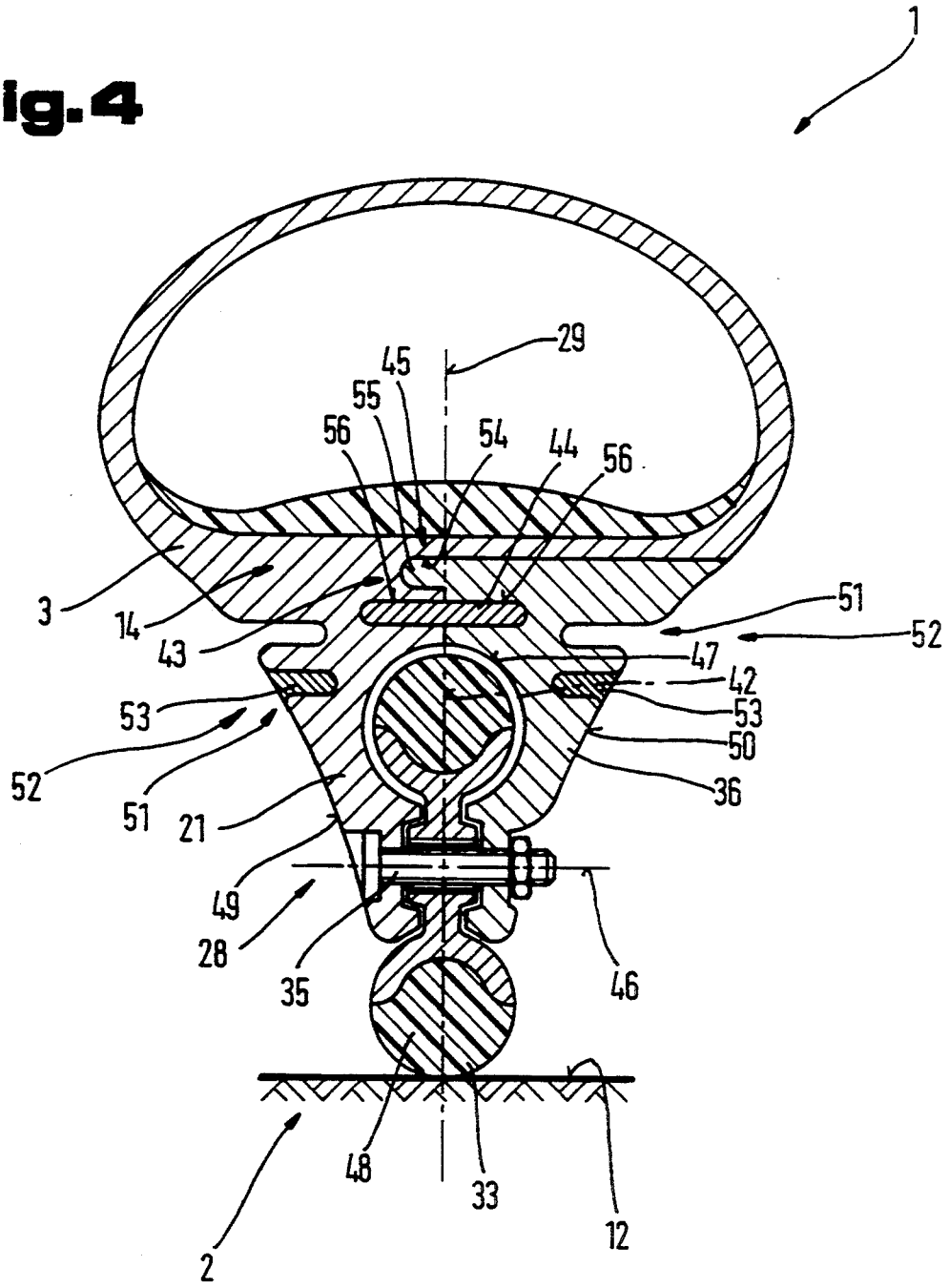
FIG. 4 is a cross sectional view similar to FIG. 2, showing another embodiment.
Figure 5:
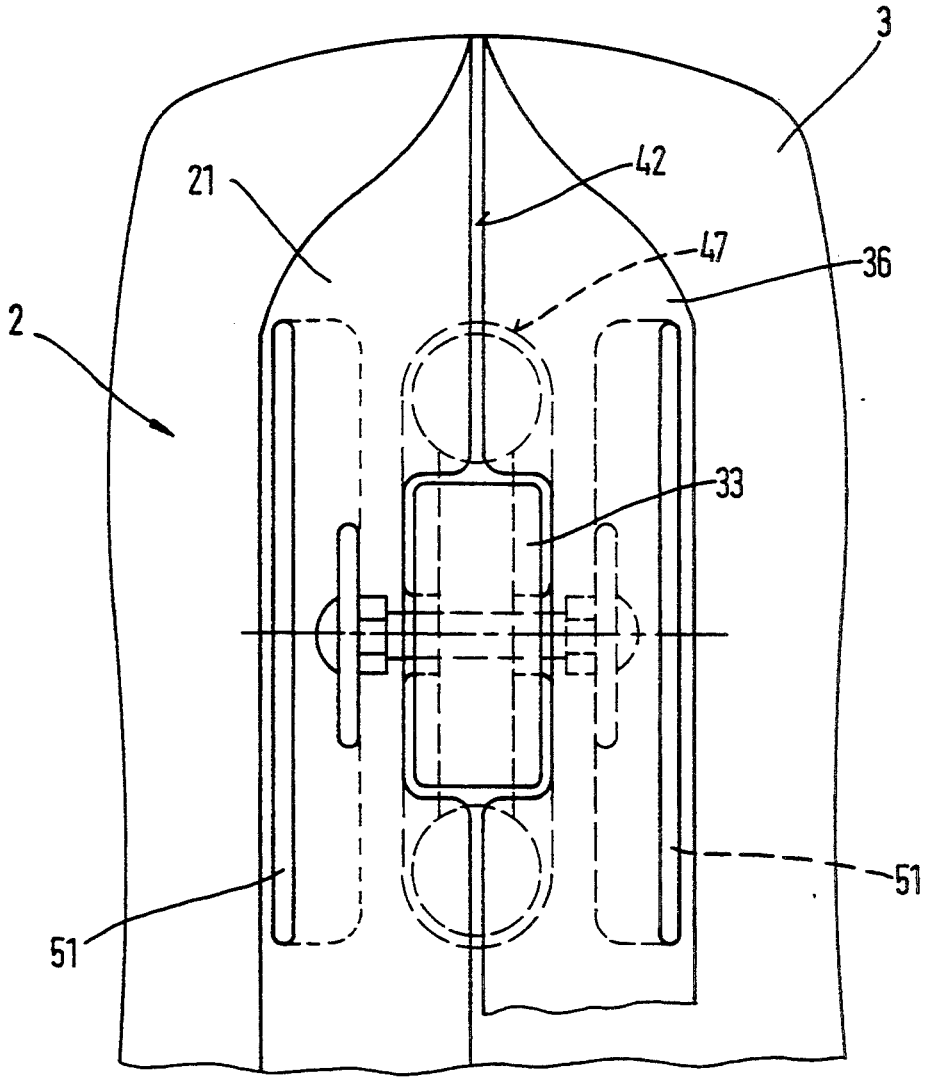
FIG. 5 is a fragmentary bottom view of the embodiment of FIG. 4.

FIGS. 4 and 5 illustrate another embodiment of skating shoe 1 with roller arrangement 2, the same reference numerals designating like parts described hereinabove. At sole 14, shell 3 is integrally formed with bearing housing 21 with its ledge-shaped extension 28 projecting towards support surface 12. The bearing housing extends over the entire length of the shoe and is asymmetric with respect to plane of symmetry 29, side face 42 of bearing housing 21 extending in the plane of symmetry. Support housing part 36 is arranged mirror-symmetrically with respect to bearing housing 21 on the other side of the plane of symmetry. Coupling means 45 is comprised of cooperating and complementary guide arrangements 43, such as guide ledges 44, in bearing housing part 21 and support housing part 36 for properly positioning the support housing part. In this embodiment, the bearing housing is comprised of more than one part relative to plane of symmetry 29 and one of the bearing housing parts is integral with the sole.

In the range of rollers 33, support housing part 36 and bearing housing 21 integral with sole 14 define cooperating and complementary recesses 47 arranged symmetrically with respect to plane of symmetry 29, roller 33 with roller rim 48 being held in the recesses. A major circumferential portion of the roller and its rim are enclosed in this manner by the bearing housing and support housing part.

The bearing housing and support housing part have opposite side faces 49 defining longitudinally extending, slot-shaped recesses 51 constituting zones 52 of elasticity and weakness in the bearing housing and support housing part. In the illustrated embodiment, two parallel sets of recesses 51 are provided and the recesses of at least one set comprise material 53 lodged in the recesses, the material differing from that of the shell and having vibration damping properties. The properties of material 53 are selected to provide desired stiffness and/or elasticity characteristics.

As shown in the drawing, coupling means 45 may be constituted, for example, by resilient tongue 55 projecting from support housing part 36 into, and frictionally engaging, complementary groove 54 in end face 42 of housing part 21. In addition, guide bar 44 of a hard synthetic resin or of metal may be arranged in slot 56 defined by complementary recesses in the bearing housing and the support housing part to enhance the stability of the bearing and to assure a lasting accuracy in the positioning of the support housing part relative to the bearing housing.

Figure 6:
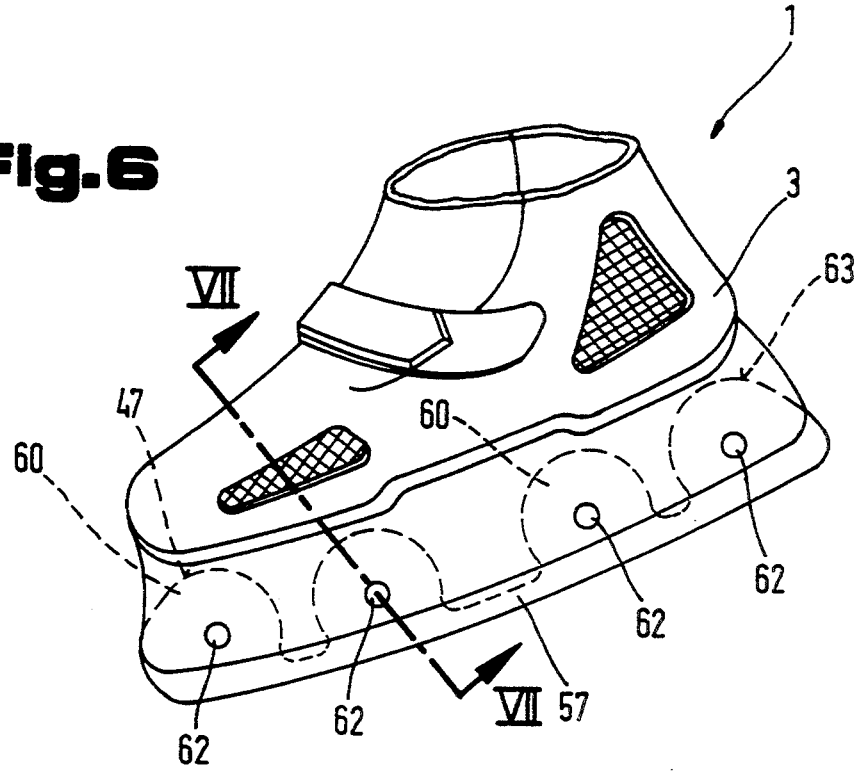
FIG. 6 is a schematic perspective view of another embodiment showing an ice skating shoe according to this invention.
Figure 7:
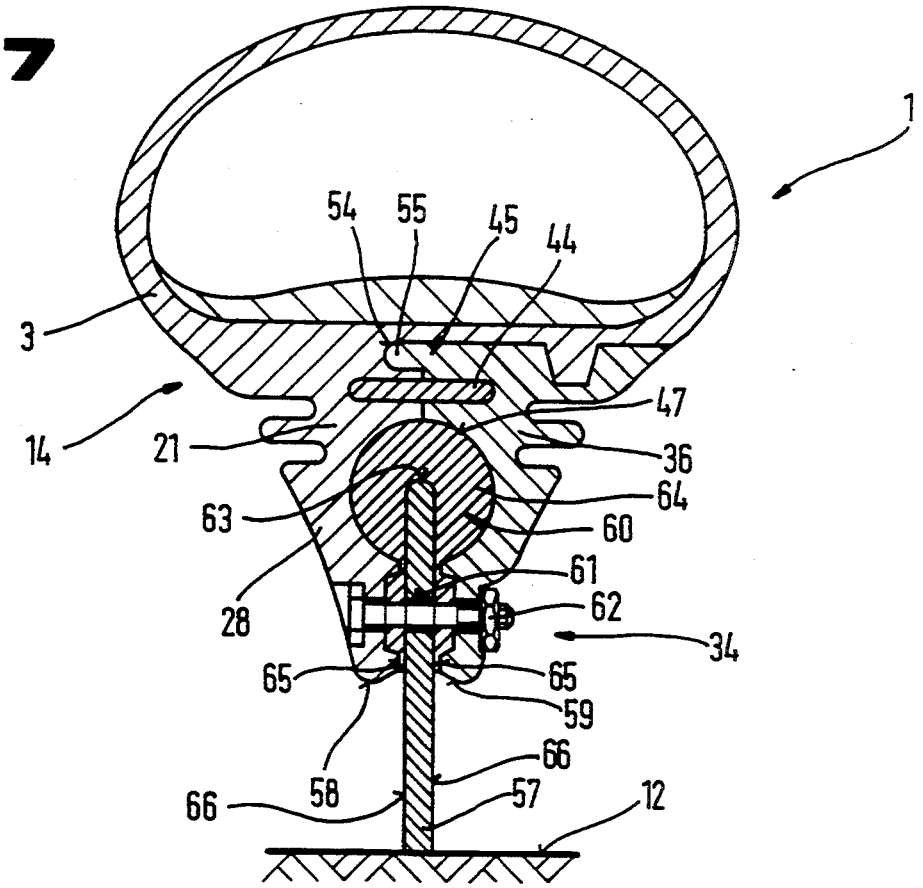
FIG. 7 is a section along line VII—VII of FIG. 6.

FIGS. 6 and 7 illustrate an ice skating shoe 1 which is equipped with an ice skating blade, like reference numerals again designating like parts described hereinabove in connection with the other embodiments. The underside of sole 14 is equipped with bearing housing 21 including ledge-shaped bearing element 28, and support housing part 36 is coupled to the bearing housing by coupling means 45, all in a manner described hereinabove in connection with FIG. 4. Ice skating blade 57 projects towards support surface 12 from lower ends 58, 59 of the bearing housing and complementary support housing part which carry the ice skating blade. The ice skating blade has circularly shaped extensions 60 (see FIG. 6) projecting into bearing housing 21 and support housing element 36, and the ice skating blade extensions define holes 61 receiving fastening elements 62 at bearing 34 to attach the ice skating blade to the shoe. Elastic clamping elements 64 are received in complementary recesses 47 in bearing housing 21 and support housing part 36, ice skating blade extensions 60 having inner end 63 projecting into the clamping elements and held thereby. Tightening of fastening elements 62 causes clamping faces 65 of bearing housing 21 and support housing part 36 clampingly to engage side faces 66 of ice skating blade 57 so that the same is held rigidly in bearing 34. Bulbous clamping elements 64 may be a separate component which is mounted on inner end 63 of the ice skating blade extension but it may also be cast on it so that it becomes a fixed component of the ice skating blade.

In this embodiment, the shoe may be selectively equipped with skating roller arrangement 2 or ice skating blade 57 simply by loosening the fastening elements and exchanging one skating means by the other.

Figure 8:
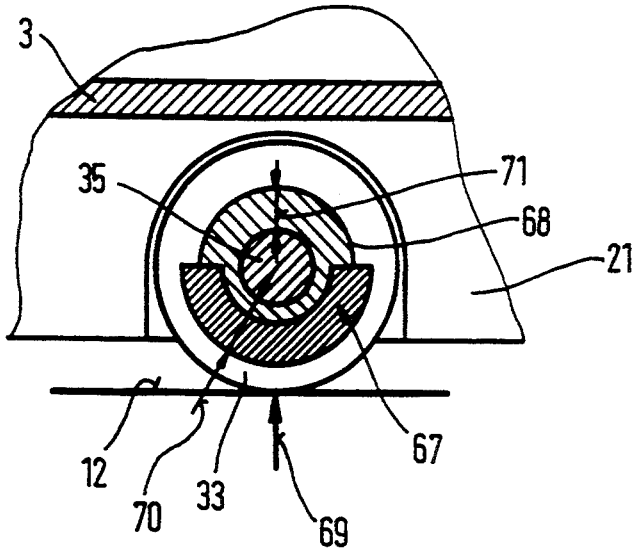
FIG. 8 is a fragmentary side elevation showing an elastic roller bearing for the roller axle, which is shown in cross-section.

FIG. 8 illustrates an elastic bearing 67 for rollers 33. This is comprised of substantially cylindrical clamping element 68 encompassing rotary axle 35 and arranged in the bearing housing 21 coaxially with rotary axle 35. This arrangement damps impacts to which roller 33 is subjected in the direction of arrow 69 and thus prevents their transmission to the bearing and the shell. This damping action will be enhanced if the portion of clamping element 68 facing support surface 12 has a wall thickness 70 greater than thickness 71 of the clamping element portion facing shell 3.

Figure 9:
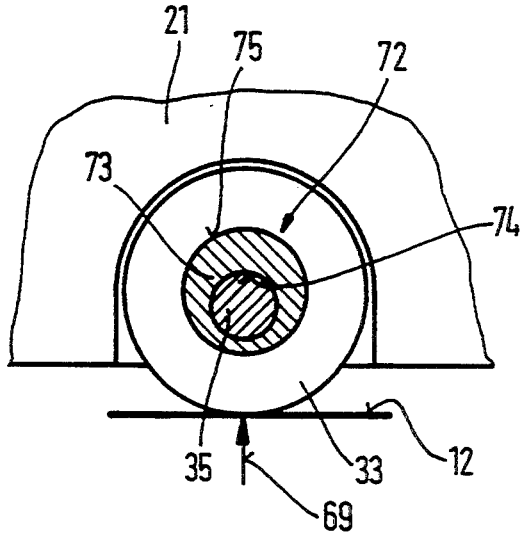
FIG. 9 is a like view showing a vertically adjustable roller bearing.
Figure 10:
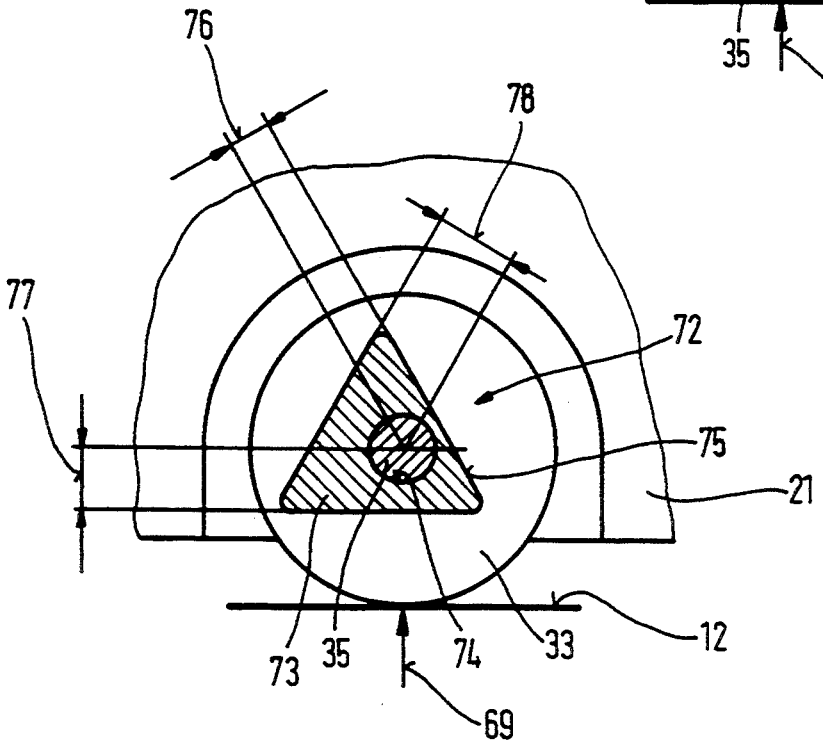
FIG. 10 shows another embodiment of a vertically adjustable roller bearing.

FIGS. 9 and 10 illustrate bearing embodiments for roller 33, which comprise vertical adjustment device 72 for a support bushing 73 encompassing rotary axle 35. The support bushing has an eccentric bore 74 holding the rotary axle eccentrically with respect to the circular circumference of the bushing. In this embodiment, the vertical position of roller 33 may be steplessly adjusted relative to bearing housing 21 and/or support housing part 36.

In the embodiment of FIG. 10, the bushing has a triangular circumference, which enables the roller to be adjusted vertically in steps corresponding to distances 76, 77, 78 of the axis of rotary axle 36 from a respective side of the triangular circumference when bushing 73 is turned with respect to the roller.

If support bushing 73 is made of elastic material, it will also have a damping effect for impacts in the direction of arrow 69.

What is claimed is:

1. A roller skating shoe integrally injection molded of synthetic resin and comprising (a) a shell defining an interior space for receiving a foot and including a sole, (b) a shaft projecting from the shell for receiving a portion of a leg projecting from the foot, and (c) a bearing device extending in a longitudinal direction along substantially the entire length of the sole on an underside thereof, and the roller skating shoe further comprising (d) a heat-insulating liner form-fitted inside the shell and facing the interior space, (e) tensioning elements affixed to the shell and the shaft for tightening the shell and the shaft about a foot and leg portion received in the interior space of the shell and in the shaft, (f) a bearing housing for a succession of skating rollers form-fittingly connected to the bearing device and extending towards a support surface on which the skating rollers support the shoe, (1) each of the skating rollers having a horizontal rotary axle journaled in the bearing housing, the rotary axle having an end face defining a recess, and (g) a support housing part mounted on the bearing housing, (1) the housing part having a support bolt coaxial with the rotary axle and engaging the recess to support the axle, and (h) the bearing housing and the support housing part having coupling means comprised of cooperating and complementary, transversely extending, interengaging ribs and grooves coupling the support housing part to the bearing housing.

2. The roller skating shoe of claim 1, wherein the bearing housing has a ledge-shaped extension extending in the longitudinal direction and projecting towards the support surface, the bearing housing extension having a side face facing a plane of symmetry extending vertically through the shoe in the longitudinal direction, the side face of the bearing housing extension extending parallel to the plane of symmetry, and the skating roller axle being journaled on the side face.

3. The roller skating shoe of claim 1, wherein the bearing housing and the support housing part are arranged at respective sides of a plane of symmetry extending vertically through the shoe in the longitudinal direction.

4. The roller skating shoe of claim 1, wherein the shell defines breathing openings.

* * * * *